US007815070B2

(12) United States Patent
Shoemaker

(10) Patent No.: US 7,815,070 B2
(45) Date of Patent: Oct. 19, 2010

(54) WIPES CONTAINER PARTICULARLY CONFIGURED TO BE RETAINED IN OUTERWEAR, BAGS AND OTHER GEAR

(75) Inventor: Scott Shoemaker, Greenwood Village, CO (US)

(73) Assignee: The Gear Group, Sheridan, CO (US)

( * ) Notice: Subject to any disclaimer, the term of this patent is extended or adjusted under 35 U.S.C. 154(b) by 29 days.

(21) Appl. No.: 11/761,991

(22) Filed: Jun. 12, 2007

(65) Prior Publication Data

US 2007/0284386 A1 Dec. 13, 2007

Related U.S. Application Data

(60) Provisional application No. 60/804,534, filed on Jun. 12, 2006.

(51) Int. Cl.
*B65H 1/00* (2006.01)

(52) U.S. Cl. ..... 221/45; 221/312 C

(58) Field of Classification Search ..... 221/33, 221/34, 35, 38, 44, 45, 46, 49, 62, 63, 64, 221/83, 97, 100, 101, 105, 120, 121, 122, 221/185, 186, 197, 199, 241, 282, 302
See application file for complete search history.

(56) References Cited

U.S. PATENT DOCUMENTS 3,967,756 A * 7/1976 Barish ..... 221/45
3,982,659 A * 9/1976 Ross ..... 221/63
3,994,417 A * 11/1976 Boedecker ..... 221/48
4,628,827 A * 12/1986 Litter ..... 109/50
D313,816 S * 1/1991 Evans ..... D19/75
5,234,107 A * 8/1993 Morel et al. ..... 206/462
5,447,227 A * 9/1995 Kosberg ..... 206/233
6,112,936 A * 9/2000 Arizmendi ..... 221/45
6,431,360 B1 * 8/2002 Julius ..... 206/494
2003/0006244 A1 * 1/2003 Silvers ..... 221/97
2003/0159403 A1 * 8/2003 Verespej et al. ..... 53/412
2004/0116046 A1 * 6/2004 Miyawaki et al. ..... 446/491
2005/0029280 A1 * 2/2005 Hayes et al. ..... 221/34
2006/0157496 A1 * 7/2006 Tagliareni ..... 221/63

* cited by examiner

*Primary Examiner*—Gene Crawford
*Assistant Examiner*—Kelvin L Randall, Jr.
(74) *Attorney, Agent, or Firm*—Gregory P. Durbin; Polsinelli Shughart PC

(57) ABSTRACT

A wipe container configured to fit in garments and bags with pockets that allow access to the wipes from the outside of the bag or garment. In one example, a carrying bag includes a pocket with a defined area having a dimension sufficient to receive the dispenser. Besides an opening in which to insert the dispenser, the pocket or specifically defined area has an additional opening or "window". The dispenser includes a container having a first opening and a retaining assembly having a second opening that snaps to the container such that the opening are aligned. The retaining assembly secures the dispenser within the pocket and with respect to the pocket window. A lid is secured to the retaining assembly and placed over the second window, and when opened allows access through the first and second openings to wipes stored in the container.

13 Claims, 11 Drawing Sheets

WIPES CONTAINER PARTICULARLY CONFIGURED TO BE RETAINED IN OUTERWEAR, BAGS AND OTHER GEAR

CROSS-REFERENCE TO RELATED APPLICATIONS

The present application is a non-provisional application claiming priority under 35 U.S.C. §119(e) to provisional application No. 60/804,534, titled "Wipes Container Particularly Configured to be Retained in Outerwear, Bags, and other Gear," filed on Jun. 12, 2006, which is hereby incorporated by reference herein. The present application is also related to U.S. application Ser. No. 11/530,361 titled "Outerwear, Bags, and Other Gear Including Retaining Structures Particularly configured for Carrying Baby Care Articles," filed on Sep. 8, 2006, which is hereby incorporated by reference herein.

FIELD OF INVENTION

Aspects of the present invention generally involve a bag, jacket or the like and an associated wipes container and in one particular aspect involves a wipes container with a detachable retaining structure including a lid wherein the retaining structure configured to be retained in outerwear, bags, and other gear containing a retaining structure.

BACKGROUND

Towelettes, or wipes, are convenient vehicles for cleansing or the application of some products to the skin. Parents of small children are intimately aware of the versatility of towelettes for, among other things, cleaning children during diaper changes, before or after meals, and other situations. Oftentimes, wipes are held in some form of conventional wipes container, which come in various sizes configured to hold only a small number of wipes, e.g., 10-50, or a larger number of wipes, e.g., 50-200. Irrespective of the size, the wipes container is often held loose in a bag, a jacket pocket, or simply left out in a car or a child's room. In any number of situations, whether in a restaurant at the table with small children, changing diapers in a mall restroom, or the like, quick access to wipes without fumbling around in a bag amongst other sundry childcare items would make the situation less stressful and make cleaning more convenient.

Aspects of the present invention allow access to the wipes at the surface of a diaper bag, jacket pocket or the like. Aspects of the present invention also allow for easy, one-handed access because the body of the container is held by the bag thus obviating the need for a second hand to hold the container in place while the wipe is extracted from the container. Moreover, aspects of the present invention allow for the container to be placed in a variety of products including bags and clothing. These and other advantages of various aspects of the present invention are described in greater detail below.

SUMMARY

One aspect of the present invention involves a dispenser for holding and dispensing towelettes. The dispenser includes a container dimensioned to hold towelettes. The container includes a bottom portion and a top portion defining a first opening. The dispenser further includes a retaining assembly releasably coupled with the container. The retaining assembly defines a second opening aligned with the first opening in the container. The retaining assembly further includes a lid dimensioned to cover the second opening.

Another aspect of the present invention involves a dispenser for holding and dispensing towelettes. The dispenser includes a container dimensioned to hold towelettes. The container includes a bottom portion and a top portion defining a first opening. The dispenser further includes a retaining assembly coupled with the top portion of the container. The retaining assembly includes a frame defining a second opening aligned with the first opening. The retaining assembly further including a lid hingedly coupled with the frame assembly. The lid is dimensioned to cover the second opening. Finally, the dispenser further includes at least one lip spanning a distance separating a periphery of the first opening and a periphery of the second opening.

DETAILED DESCRIPTION OF EMBODIMENTS OF THE INVENTION

Various embodiments conforming to aspects of the invention involve a towelette dispenser, also referred to as a wipes container, conformed to fit in garments and carrying bags arranged with a pocket, compartment, or other holding structure, which may be customized to hold a particular sized or shaped dispenser. For example, a carrying bag includes a pocket with a defined area having a dimension sufficient to receive the dispenser. The dispenser can be arranged and dimensioned to dispense various types of towelettes including baby wipes, cleansing clothes, disinfecting wipes, moisture wipes, bug repellant wipes, towelettes and tissue. Besides an opening or pocket in which to insert the dispenser, the pocket also has an additional opening or "window." The dispenser may be placed within the pocket to position a dispenser lid in the window. The dispenser includes a retaining assembly that secures the dispenser within the pocket and with respect to the pocket window. The retaining assembly may also include a lid for accessing wipes within the dispenser. Thus, the dispenser is secured in the pocket by the retaining assembly, and ready access to the wipes held in the dispenser is made by way of the lid in the retaining assembly.

Figure 1:
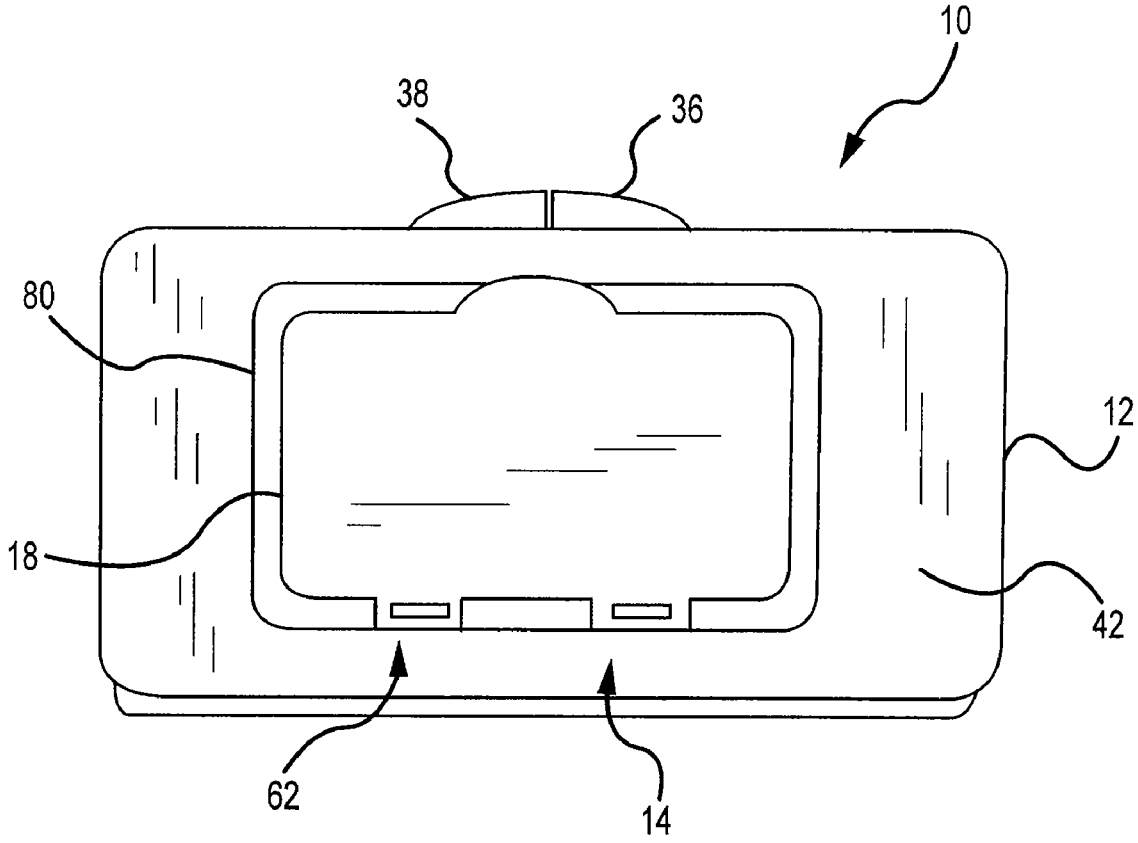
FIG. 1 is a top view of a wipes dispenser.
Figure 2:
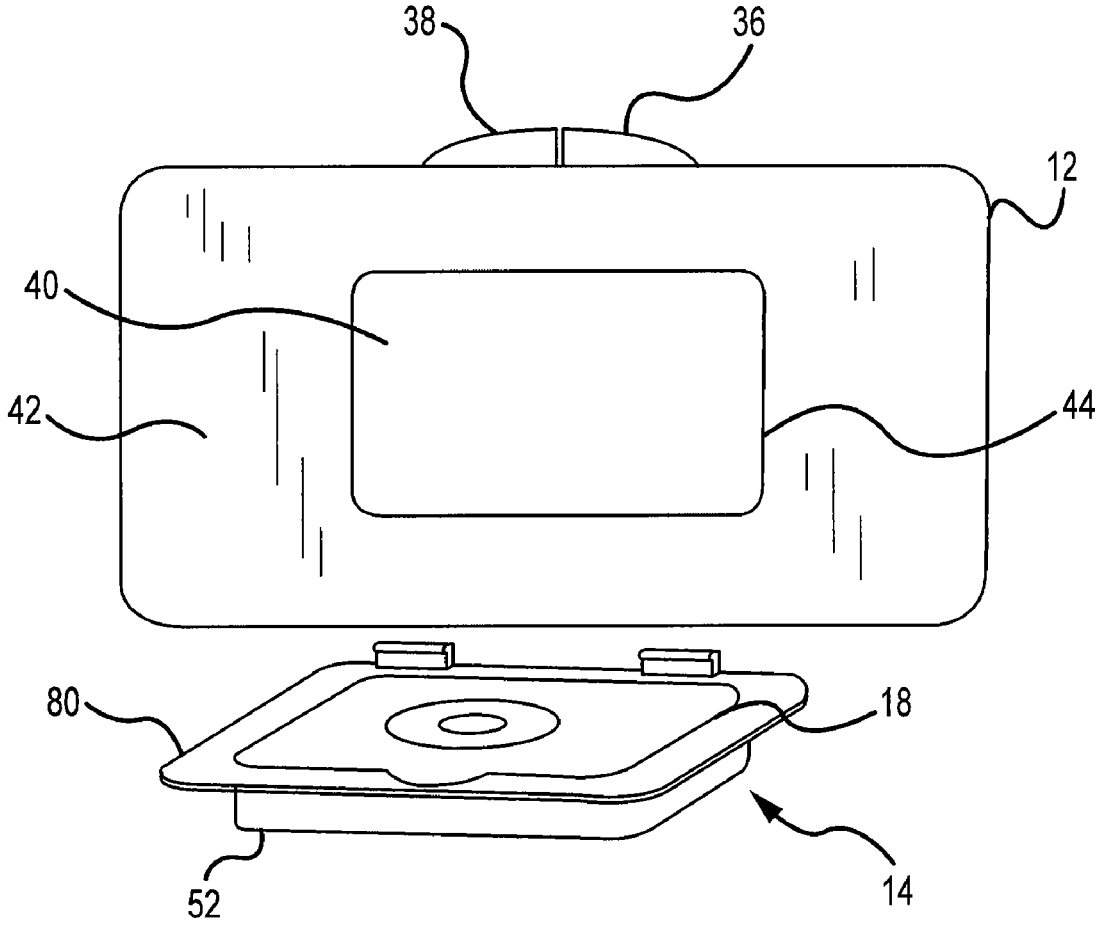
FIG. 2 is a top view of the wipes dispenser of FIG. 1 having a frame portion and a lid portion removed from a container portion.
Figure 3:
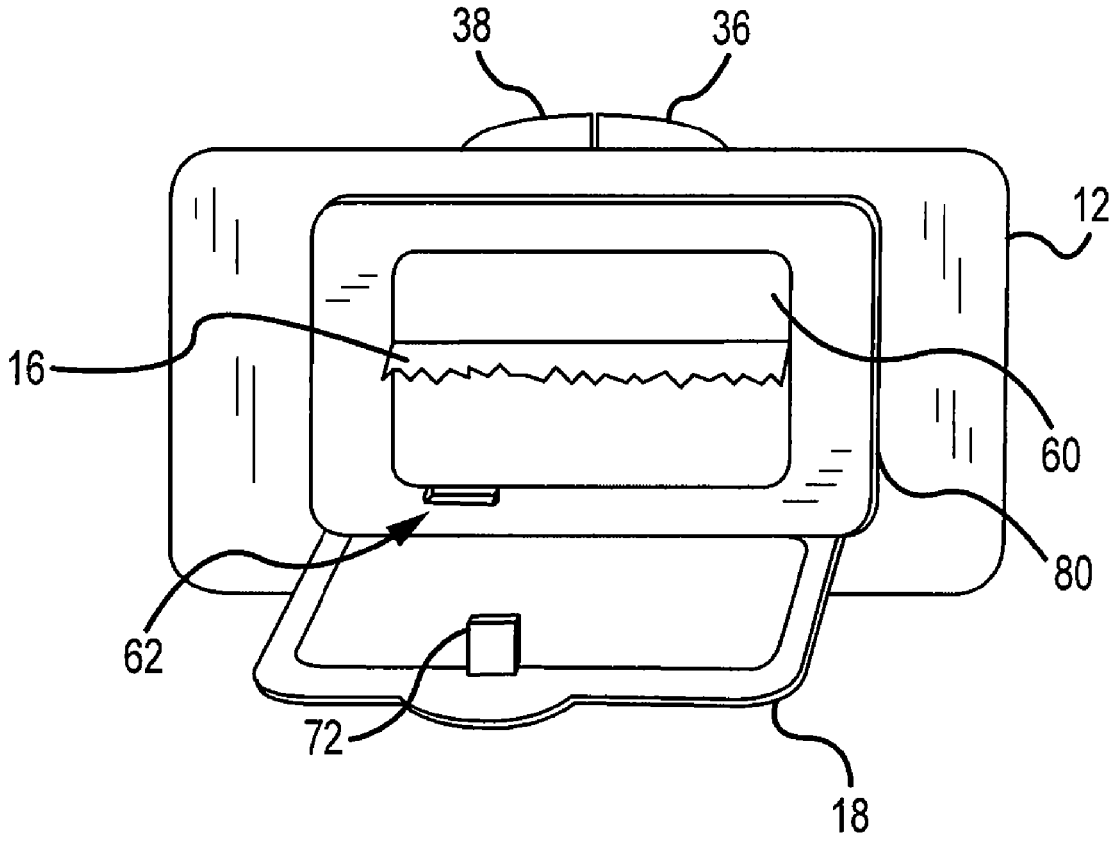
FIG. 3 is a top view of the wipes dispenser of FIG. 1 showing the frame snapped onto a top portion of the wipes container and the lid open.
Figure 4:
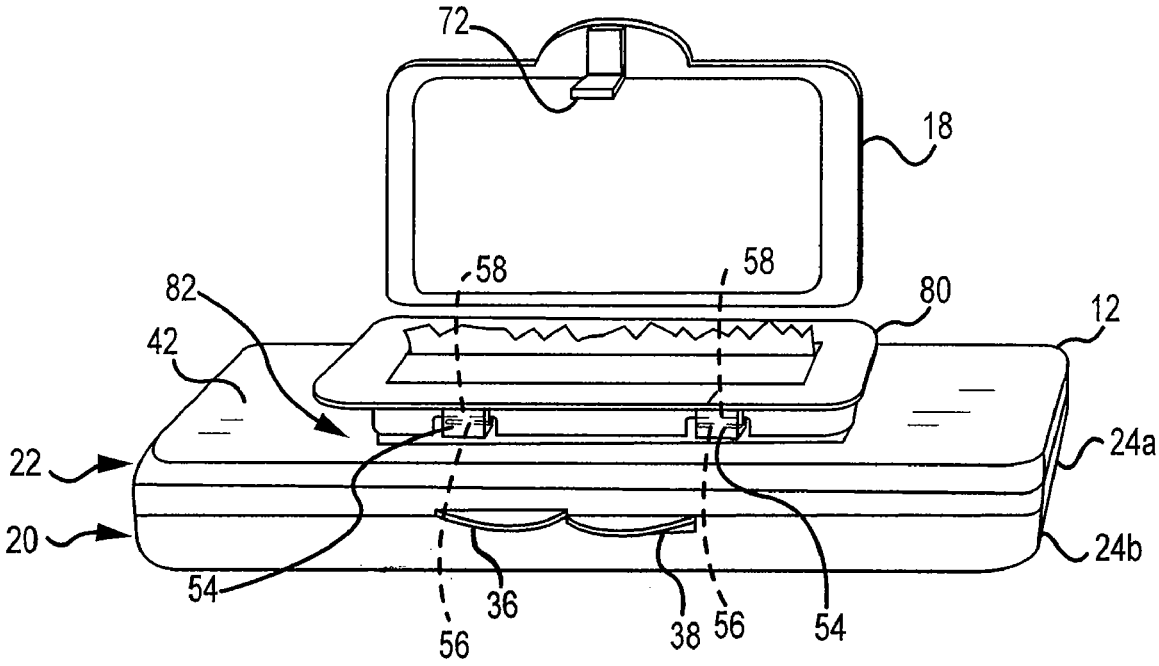
FIG. 4 is a front view of the wipes dispenser showing the frame snapped on the top portion of the wipes container and the lid open on the frame, the front view further illustrating a retaining channel adapted to receive a periphery of an opening.

FIG. 1 illustrates a top view of one example of a dispenser 10 conforming to aspects of the present invention. The dispenser includes a container 12 portion configured to hold towelettes (also referred to herein as wipes) 16 and also includes a retaining assembly 14. FIG. 2 is also a top view of the dispenser shown in FIG. 1; however, the retaining assembly has be disconnected from the container. FIGS. 3 and 4 are a front view and a side view, respectively of the dispenser of FIG. 1, with a lid 18 in the retaining assembly in an open position to facilitate access to wipes held in the container.

With reference to FIGS. 1-4 and others, the dispenser 10 includes the container 12 having a bottom portion 20 and a top portion 22 wherein the bottom and top portions are hingedly attached to one another so that the container can be opened to load wipes and closed to contain the wipes. The container portion may be dimensioned in various ways in order to hold various numbers of wipes and hold various shapes of wipes. The depth of the container defined by the height of cooperating sidewalls (24*a*, 24*b*) of the top and bottom portions, which are perpendicular to the surface of the folded wipes 16, define the number of wipes the container can hold. The lower portion may be configured with a tongue 26 to be accepted into a corresponding groove 28 defined by the lower edge 30 of the top portion. The bottom portion may be further configured to have a small protrusion 32 extending substantially perpendicular to the wall of the container that snaps into a corresponding indentation 34 positioned in the wall of the top portion. The top and bottom portions may be configured with tabs (36,38) on the exterior of the container extending away from the sides and near the interface of the two portions. These tabs do not substantially overlap so that when opening the container, two fingers from one hand may be used to pry open the container by pushing against the tabs in opposite directions.

As shown in FIG. 2, the top portion 22 defines an opening 40 in its upper surface 42 for access to the wipes 16 therein. A lip 44 projects outwardly from the top portion around the periphery of the opening. In the particular implementation set forth in FIGS. 1-4, the opening is substantially rectangular in shape. The opening, however, may have other shapes, such as ovals, squares, etc.

Figure 5:
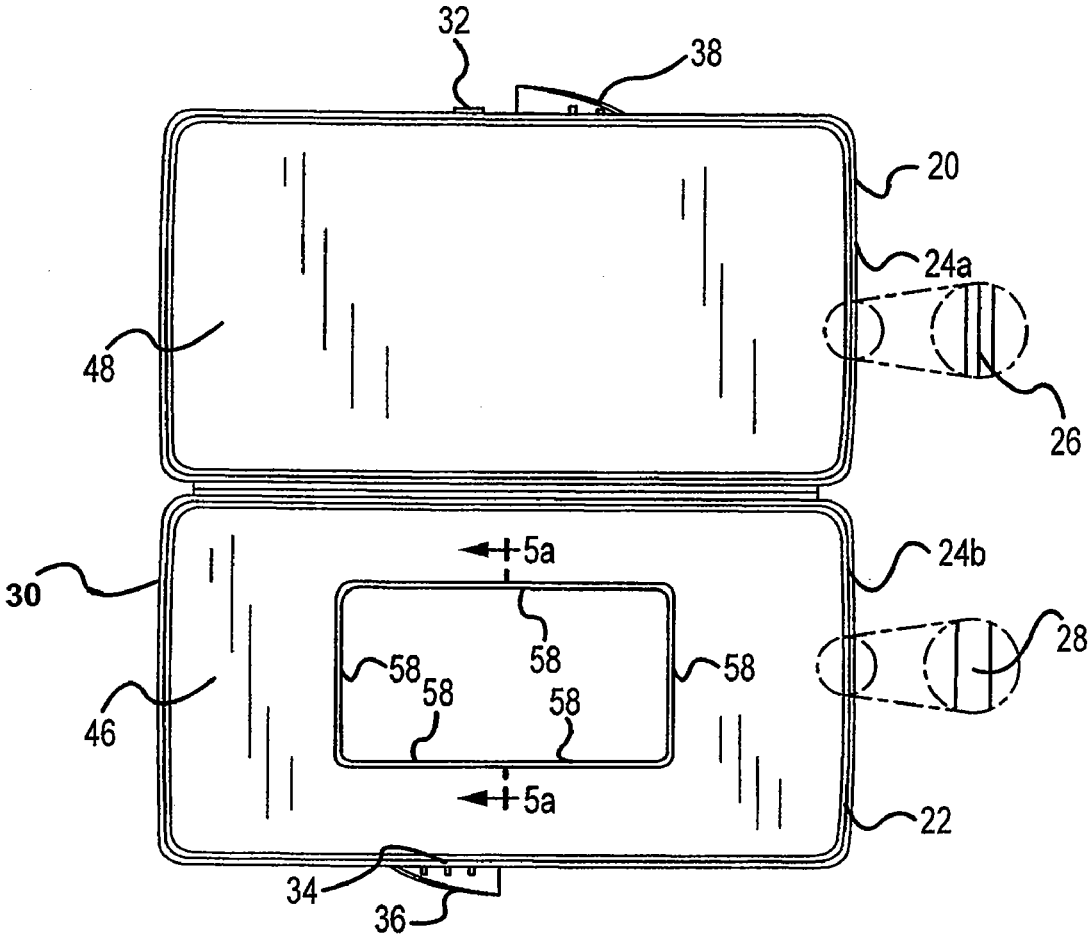
FIG. 5 is a top view of the wipes container with the top portion hingedly attached and open at about a 180 degree angle from a bottom portion of the container.
Figure 5A:
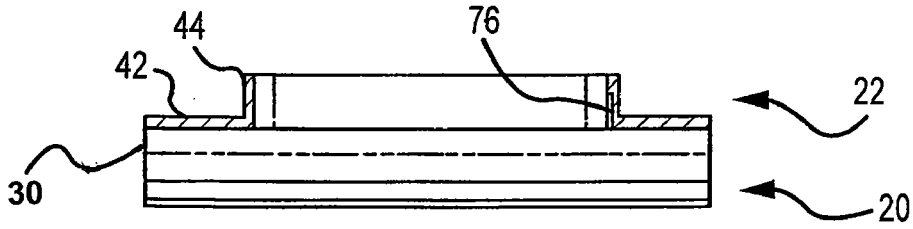
FIG. 5*a* is a section view taken along line 5*a*-5*a* of FIG. 5.

FIG. 5 is an inside view of the container 12 portion of the dispenser 10 illustrating the inside 46 of the bottom portion and the inside 48 of the top portion of the container. FIG. 5A is a section view taken along line 5A-5A of FIG. 5, particularly illustrating the lip and the opening in the top portion. FIGS. 6-10 are various views of a frame portion 50 of the retaining assembly 14, with FIG. 10 being a section view taken along line 10-10 of FIG. 6 particularly illustrating a portion of a second lip 52 configured to engage the first lip of the container, as discussed in greater detail below. FIGS. 11-17 are various views of the lid portion 18 of the retaining assembly.

Referring now to FIGS. 1-17, dispenser 10 includes the retaining assembly 14, which includes a frame member 50 adapted to be removably engaged with the lip 44 around the periphery of the opening 40 in the container. The frame defines a second lip 52 of a similar shape as the first lip. The second lip has a slightly greater dimension than the first lip and therefore fits snuggly over and around the first lip. The lip configurations, e.g., size, shape, depth, etc., may be altered in any particular implementation. The first and second lips include corresponding snap features 54 that allow the frame 50 to snap to the container. The snap features of the retaining assembly 14 having small protrusions 56 extending toward the center of the opening 40 and positioned near the bottom of the snap feature. These protrusions in the lip structure 52 of the retaining assembly correspond in shape and location to apertures 58 in the lip structure 44 of the top portion. The snap features and protrusions being placed in an asymmetric, or symmetric pattern around the periphery of the opening.

Figure 6:
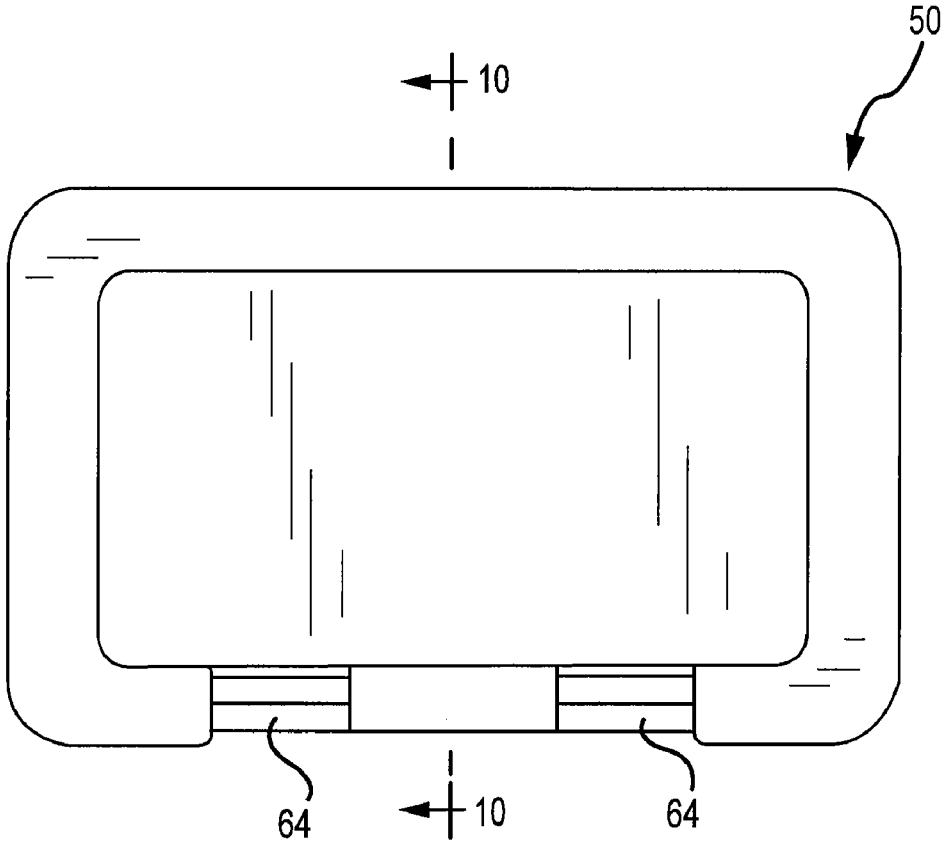
FIG. 6 is a top view of the frame.
Figure 8:
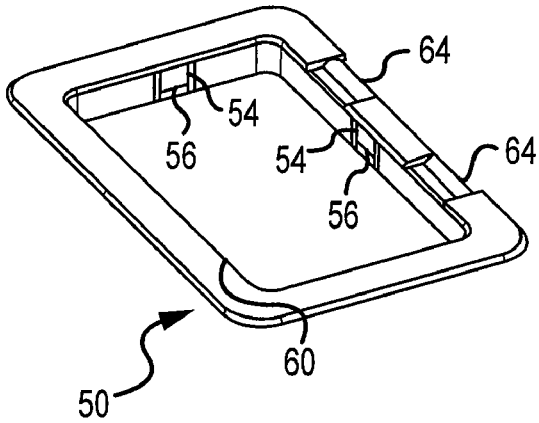
FIG. 8 is an isometric view of the top of the frame.

As shown in FIGS. 2, 6, 8 and others, the frame 50 portion of the retaining assembly 14 also includes a rectangular frame opening 60 or aperture of similar size and shape to the opening 40 in the container 12 portion. The second lip 52 extends around the periphery of the rectangular aperture. When the retaining assembly is connected with the container, the container opening and the frame opening are aligned.

The frame 50 further pivotally supports a lid 18 adapted to close over the frame opening 60. As mentioned above, the opening in the frame aligns with the opening in the top portion 22 when the frame snaps engage the top portion. Thus, the lid can be opened to access wipes 16 within the container portion 12. The lid structure is secured to the frame portion with a hinge assembly 62. The hinge assembly includes two pins 64 secured to the frame portion and corresponding channel structures 66 at the edge of the lid. The pins are rotatably supported in the channel structures. The channel structures have an opening 68 slightly smaller than the pin diameters leading to a cylindrical interior 70 that is slightly larger than the pin diameters so as to allow secure, free rotation of the lid. Near the edge of the lid structure is a tab 72 extending away from the lid. The tab contains a small protrusion 74 near the tip that fits into a corresponding indentation 76 in the inner surface of the lip of structure, that when engaged securedly holds the lid in the closed position.

Figure 7:
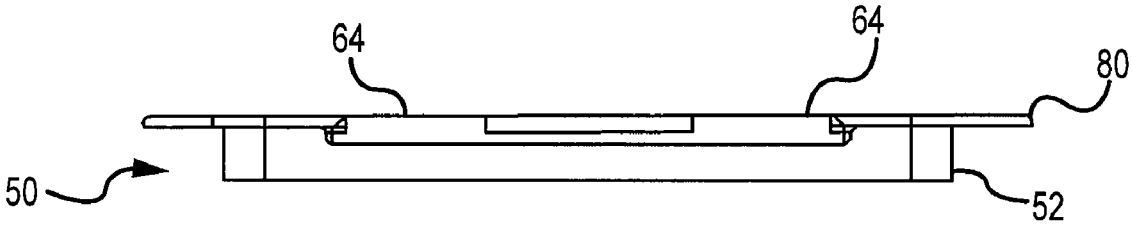
FIG. 7 is a front view of the frame.
Figure 9:
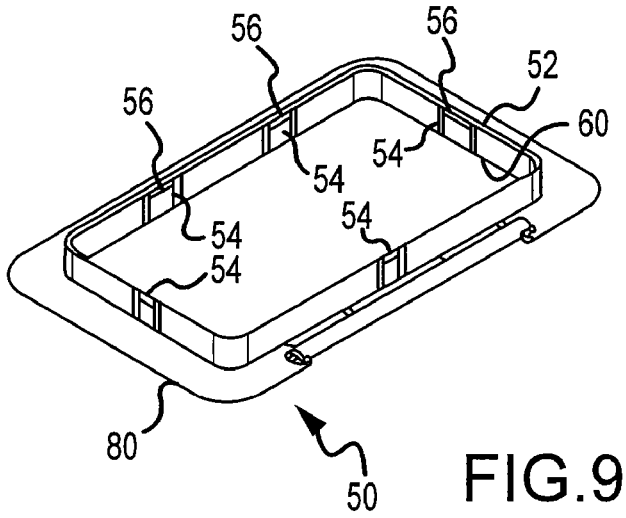
FIG. 9 is an isometric view of the bottom of the frame.
Figure 10:
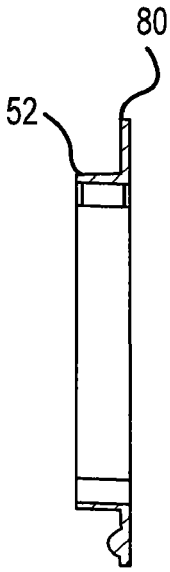
FIG. 10 is a section view taken along line 10-10 of FIG. 6.
Figure 11:
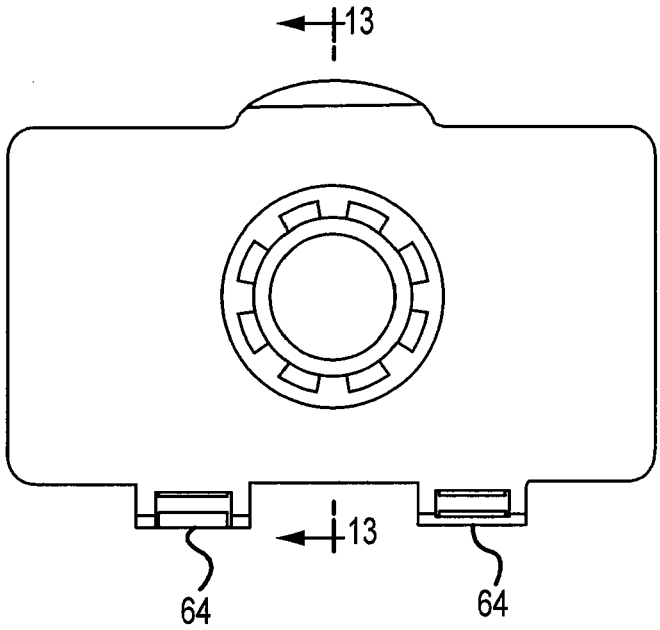
FIG. 11 is a top view of the lid.
Figure 13:
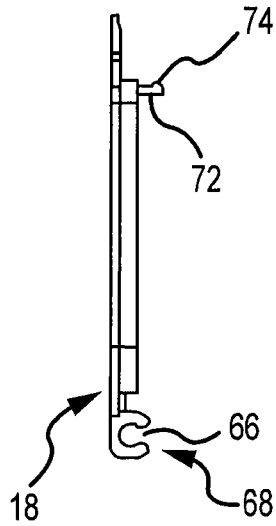
FIG. 13 is a side view of the lid.
Figure 12:
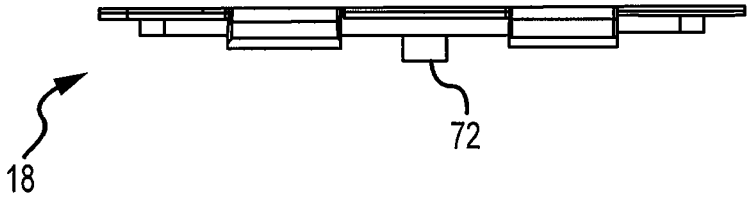
FIG. 12 is a front back view of the lid.
Figure 14:
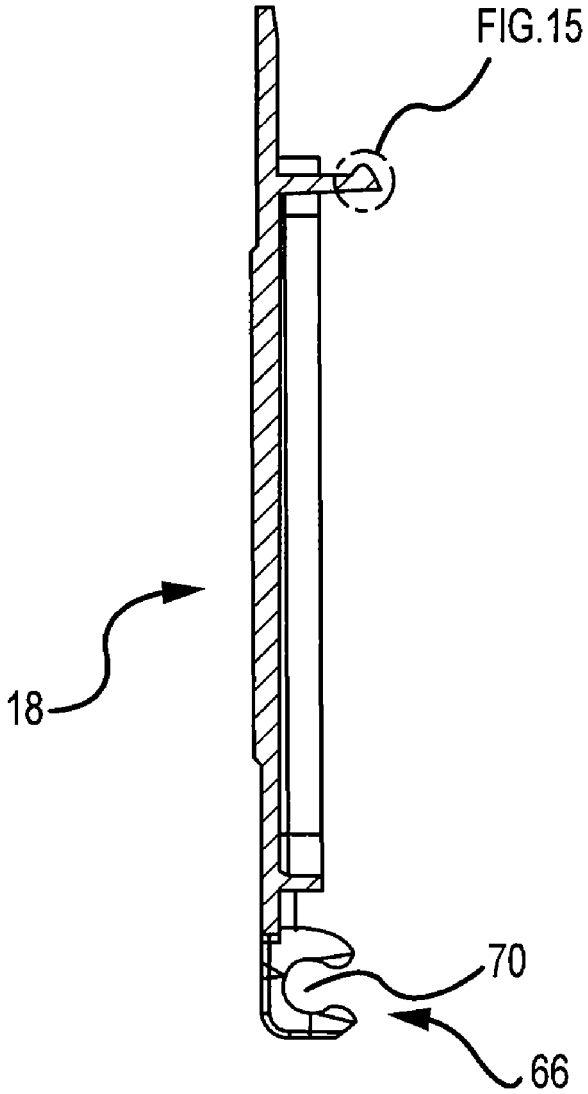
FIG. 14 is a side view of the lid.
Figure 15:
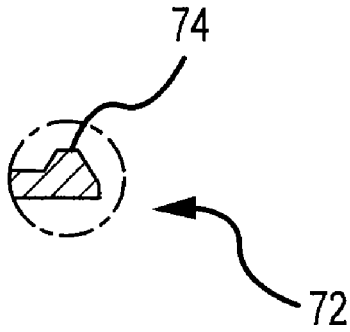
FIG. 15 is a close-up view of the snap.
Figure 16:
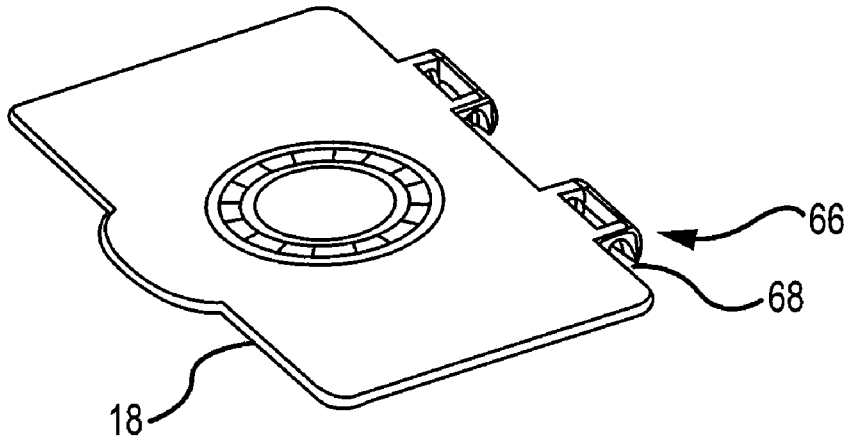
FIG. 16 is an isometric view of the top of the lid.
Figure 17:
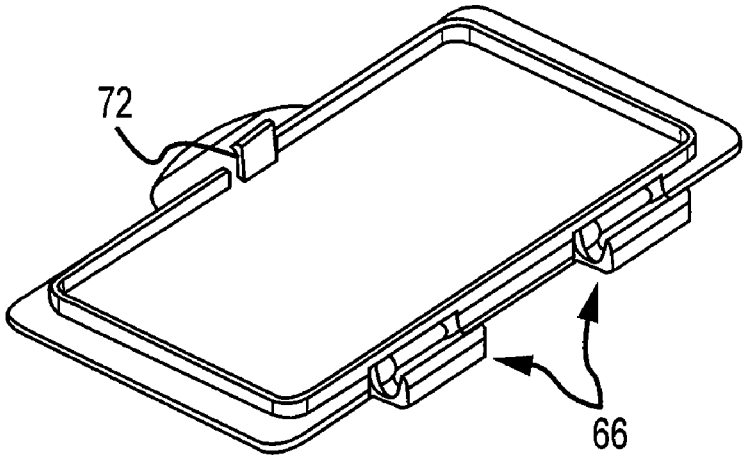
FIG. 17 is an isometric view of the bottom of the lid.

The frame lip 52 and top portion lip 44 are dimensioned to extend though a corresponding opening in a garment, carrying bag or other holding structure. As shown in FIGS. 7-9 and others, the frame includes a collar 80 extending outwardly from the second lip. The collar defines a substantially planar surface around the periphery of the frame opening and substantially perpendicular to the second or frame lip. When the frame is snapped into the opening, the top portion, first and second lips, and collar collectively define a retaining channel 82, as shown in FIG. 4 and others.

Figure 18:
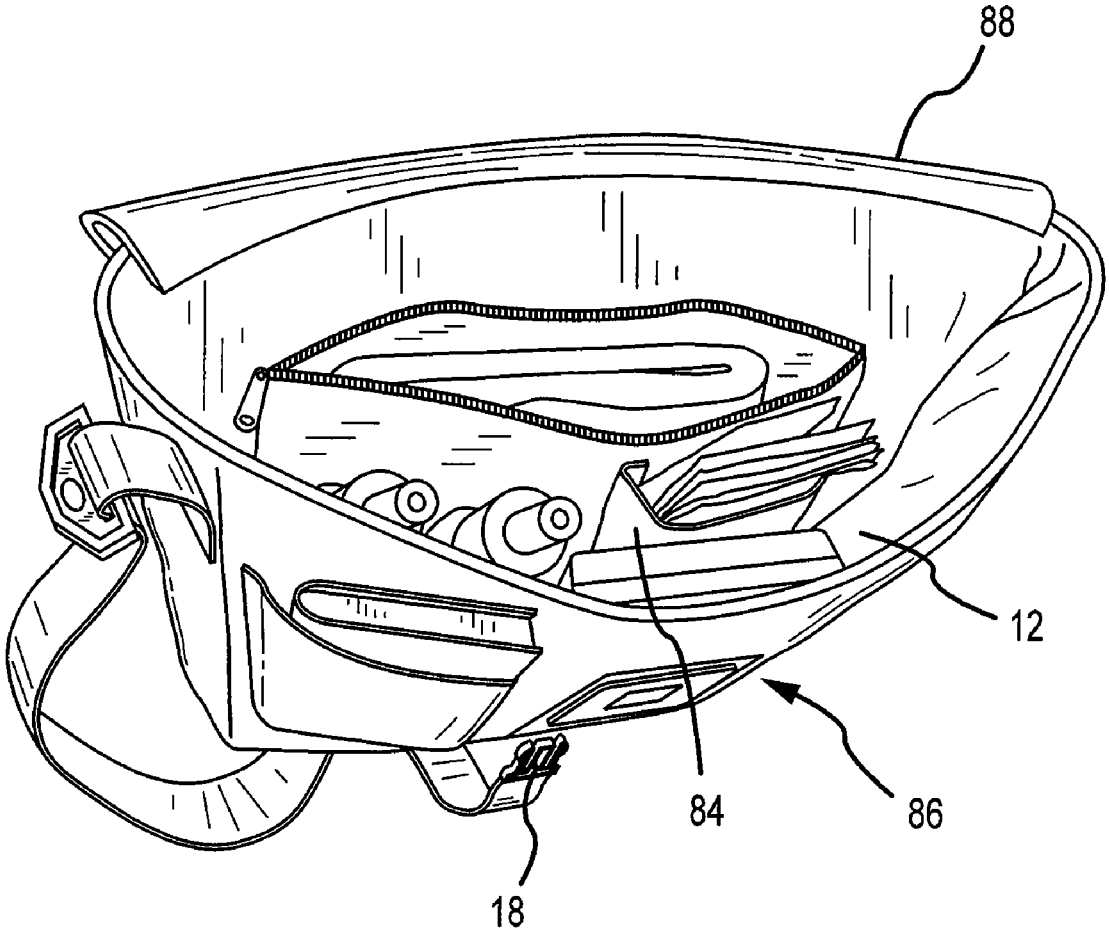
FIG. 18 is a top view of a carrying bag containing a wipes dispenser.

The retaining channel 82 structure is used to secure the dispenser 10 in a pocket 84 or other structure. The first and second lips extend through an opening 86 in the pocket, and a periphery of the pocket opening is positioned within the retaining channel. FIG. 18 illustrates one example of a diaper bag 88 having a pocket configured to receive the dispenser. Other examples of bags, garments, and the like having pockets or other retaining structures configured to receive a dispenser conforming to aspects of the present invention are described in U.S. application Ser. No. 11/530,361, referenced above.

Turning to the example bag 88 illustrated in FIG. 18, a pocket 84 is sewn into a side portion of the bag. The pocket is substantially rectangular and is dimensioned to receive the dispenser 10. The pocket further includes a window portion defined in the front wall of the bag. To install the dispenser in the bag, the retaining assembly 14 is disconnected from the container 12. The container is then placed in the pocket and the opening 40 in the top portion 22 of the container is generally aligned with the window portion 86 defined in the pocket. It is possible to dimension the pocket in such a way that placement of the container in the pocket forces the opening to align with the window. When the opening is aligned with the window, the first lip 44 is also generally aligned with the window. The retaining assembly is then secured to the container by snapping the second lip 52 on the first lip. When the retaining assembly is secured to the container, the periphery of the pocket window is secured within the channel 82.

In another aspect of the invention the retaining assembly 14 and top portion 22 are not releasably connected, rather they form a single unit. In this aspect, the entire container 12 is first placed in the pocket 84 of the garment or bag 88. The window opening 86 of the pocket is elasticized so that it can be enlarged to allow the collar 80 to exit the window. The elastisized window then contracts to around the frame 50 of the retaining assembly, securely holding the container in place.

Although various representative embodiments conforming to aspects of this invention have been described above with a certain degree of particularity, those skilled in the art could make numerous alterations to the disclosed embodiments without departing from the spirit or scope of the inventive subject matter defined in the appended claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of aspects of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A dispenser for holding and dispensing towelettes comprising:

a container dimensioned to hold towelettes, the container including a bottom portion hingedly coupled to a top portion, the top portion defining a first opening and including a first lip wall extending around a periphery of the first opening, the first lip wall extending substantially perpendicularly from the top portion;

a retaining assembly removably coupled with the container, the retaining assembly defining a second opening aligned with the first opening, the retaining assembly including a lid hingedly coupled to the retaining assembly and dimensioned to cover the second opening, a second lip wall structure extending around a periphery of the second opening and in engagement with the first lip wall, the retaining assembly further including a collar extending around the periphery of the second opening, the collar substantially perpendicular to the second lip wall and generally parallel with an outer surface of the top portion of the container, wherein the outer surface of the top portion, the corresponding first and second lip walls, and the collar define a channel configured to receive a periphery of an opening in a pocket configured to hold the dispenser; and wherein the channel has a dimension of between 2 millimeters and 1 centimeter between the outer surface and the collar.

2. The dispenser of claim 1 wherein the first opening is substantially centered in the top portion.

3. The dispenser of claim 1 wherein the collar has a width dimension of between 2 millimeters and 1 centimeter.

4. The dispenser of claim 1 wherein the first and second openings are substantially rectangular.

5. The dispenser of claim 1 further comprising a pocket having an inside portion configured to hold the container and defining a window wherein the retaining assembly is operably associated with the window to secure the dispenser in the pocket and provide access to the container.

6. The dispenser of claim 1 further comprising at least one snap configuration removably coupling the container and the retaining assembly.

7. The dispenser of claim 6 wherein the snap configuration comprises:

a plurality of protrusions extending from the second lip wall; and a plurality of apertures in the first lip wall configured such that the plurality of protrusions engage the plurality of apertures when the retaining assembly is coupled to the container.

8. The dispenser of claim 1 wherein:

the container comprises means for containing towelettes; and the retaining assembly comprises means for retaining the dispenser in a pocket window and means for providing access to wipes within the container.

9. A dispenser for holding and dispensing towelettes comprising:

a container dimensioned to hold towelettes, the container including a bottom portion hingedly coupled to a top portion defining a first opening;

a retaining assembly removably coupled with the top portion of the container, the retaining assembly including a frame defining a second opening aligned with the first opening, the retaining assembly further including a lid hingedly coupled with the frame assembly, the lid dimensioned to cover the second opening; and at least one lip spanning a distance separating a periphery of the first opening and a periphery of the second opening, wherein the top portion includes a first lip wall portion of the at least one lip, the first lip extending around a periphery of the first opening, the lip wall extending substantially perpendicularly from the top portion and the frame assembly includes a second lip wall structure extending around a periphery of the second opening and in engagement with the first lip wall;

a collar extending around the periphery of the second opening, the collar substantially perpendicular to the second lip wall and generally parallel with an outer surface of the top portion of the container; and wherein the outer surface of the top portion, the corresponding first and second lip walls, and the collar define a channel configured to receive a periphery of an opening in a pocket configured to hold the dispenser, the channel having a dimension of between 2 millimeters and 1 centimeter between the outer surface and the collar.

10. The dispenser of claim 9 further comprising a pocket having an inside portion configured to hold the container and defining a window wherein the retaining assembly is operably associated with the window to secure the dispenser in the pocket and provide access to the container.

11. The dispenser of claim 10 wherein the window periphery is elasticized so as to operably associate with a variety of sized and shaped retaining assemblies.

12. The dispenser of claim 9 wherein:

the container comprises means for containing towelettes; and the retaining assembly comprises means for retaining the dispenser in a pocket window and means for providing access to wipes within the container.

13. The dispenser of claim 9 further comprising:

a plurality of protrusions extending from the second lip wall; and a plurality of apertures in the first lip wall configured such that the plurality of protrusions engage the plurality of apertures when the retaining assembly is coupled to the container.

* * * * *